US007581915B1

(12) United States Patent
Bristol

(10) Patent No.: US 7,581,915 B1
(45) Date of Patent: Sep. 1, 2009

(54) DRYWALL LIFT ASSEMBLY INCLUDING A CENTER TELESCOPICALLY EXTENDABLE LIFTING MEANS

(76) Inventor: Ferdinand Bristol, 6034 Dewey St., Hollywood, FL (US) 33023

( * ) Notice: Subject to any disclaimer, the term of this patent is extended or adjusted under 35 U.S.C. 154(b) by 236 days.

(21) Appl. No.: 11/752,654

(22) Filed: May 23, 2007

(51) Int. Cl.
*E04G 21/14* (2006.01)

(52) U.S. Cl. ..... 414/11

(58) Field of Classification Search ..... 414/10–12, 414/427, 590, 620, 639; 52/118, 749.1; 901/1; 182/141; 212/180
See application file for complete search history.

(56) References Cited

U.S. PATENT DOCUMENTS 3,409,158 A * 11/1968 Lull ..... 414/639
3,967,738 A * 7/1976 Winings ..... 414/11
4,300,751 A 11/1981 Delaney
4,394,106 A 7/1983 Frees et al.
4,560,031 A * 12/1985 Dixon et al. ..... 182/129
4,676,713 A * 6/1987 Voelpel ..... 414/590
4,682,926 A * 7/1987 Chambers et al. ..... 414/11
5,441,379 A 8/1995 Gilbert, Jr.
6,027,295 A * 2/2000 Geppert et al. ..... 414/12
6,273,662 B1 8/2001 Fleckenstein
6,739,819 B2 5/2004 Caudill et al.
7,032,289 B2 * 4/2006 Oliver et al. ..... 29/596
2003/0059282 A1 * 3/2003 Justice ..... 414/12

* cited by examiner

*Primary Examiner*—Gregory W Adams

(57) ABSTRACT

The present invention concerns that of a new and improved drywall lift assembly that allows a single individual to support and hold a single drywall panel while he or she would be affixing this panel to a wall or ceiling of a residential or commercial building. The drywall lift assembly includes a flat panel base, a telescoping pole assembly on top of the flat panel base, a support assembly atop the telescoping pole assembly for mounting an item of drywall or flat panel sheeting, and an extension ladder attached to the telescoping pole assembly. The support assembly can move in relation to the telescoping pole assembly so that piece of drywall or flat panel can be placed on either a ceiling or a wall surface.

2 Claims, 4 Drawing Sheets

DRYWALL LIFT ASSEMBLY INCLUDING A CENTER TELESCOPICALLY EXTENDABLE LIFTING MEANS

BACKGROUND OF THE INVENTION

The present invention concerns that of a new and improved drywall lift assembly that allows a single individual to support and hold a single drywall panel while he or she would be affixing this panel to a wall or ceiling of a residential or commercial building.

DESCRIPTION OF THE PRIOR ART

U.S. Pat. No. 4,300,751, issued to Delaney, discloses a foldable and height adjustable overhead lift which contains a hydraulic pump.

U.S. Pat. No. 5,441,379, issued to Gilbert, Jr., discloses a hand cart for a wall panel assembly having a table pivotally attached to a wheeled frame with a hydraulic cylinder pivotally connected therebetween.

U.S. Pat. No. 6,273,662 B1, issued to Fleckenstein, discloses a lifting device having a hydraulic ram assembly which can be used to lift, support, and align articles such as cabinets, countertops, shelving, and the like, during installation and removal.

U.S. Pat. No. 6,739,819 B2, issued to Caudill et al., discloses a platform for lifting drywall and paneling in which the device is also equipped with extensible legs, a winch or motor, pulleys, guides, rollers, spacers, hinges, stop bars, braces, locking mechanisms, a swivel point, and a rack.

U.S. Pat. No. 4,394,106, issued to Frees et al., discloses a glass-handling lifting truck having suitable remote controls, preferably of known electric servo type, for extremely precise maneuvering and positioning.

SUMMARY OF THE INVENTION

The present invention concerns that of a new and improved drywall lift assembly that allows a single individual to support and hold a single drywall panel while he or she would be affixing this panel to a wall or ceiling of a residential or commercial building. The drywall lift assembly includes a flat panel base, a telescoping pole assembly on top of the flat panel base, a support assembly atop the telescoping pole assembly for mounting an item of drywall or flat panel sheeting, and an extension ladder attached to the telescoping pole assembly. The support assembly can move in relation to the telescoping pole assembly so that piece of drywall or flat panel can be placed on either a ceiling or a wall surface.

There has thus been outlined, rather broadly, the more important features of a drywall lift assembly that the detailed description thereof that follows may be better understood and in order that the present contribution to the art may be better appreciated. There are, of course, additional features of the drywall lift assembly that will be described hereinafter and which will form the subject matter of the claims appended hereto.

In this respect, before explaining at least one embodiment of the drywall lift assembly in detail, it is to be understood that the drywall lift assembly is not limited in its application to the details of construction and to the arrangements of the components set forth in the following description or illustrated in the drawings. The drywall lift assembly is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present drywall lift assembly. It is important, therefore, that the claims be regarded as including such equivalent constructions insofar as they do not depart from the spirit and scope of the present invention.

It is therefore an object of the present invention to provide a drywall lift assembly which has all of the advantages of the prior art and none of the disadvantages.

It is another object of the present invention to provide a drywall lift assembly which may be easily and efficiently manufactured and marketed.

It is another object of the present invention to provide a drywall lift assembly which is of durable and reliable construction.

It is yet another object of the present invention to provide a drywall lift assembly which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
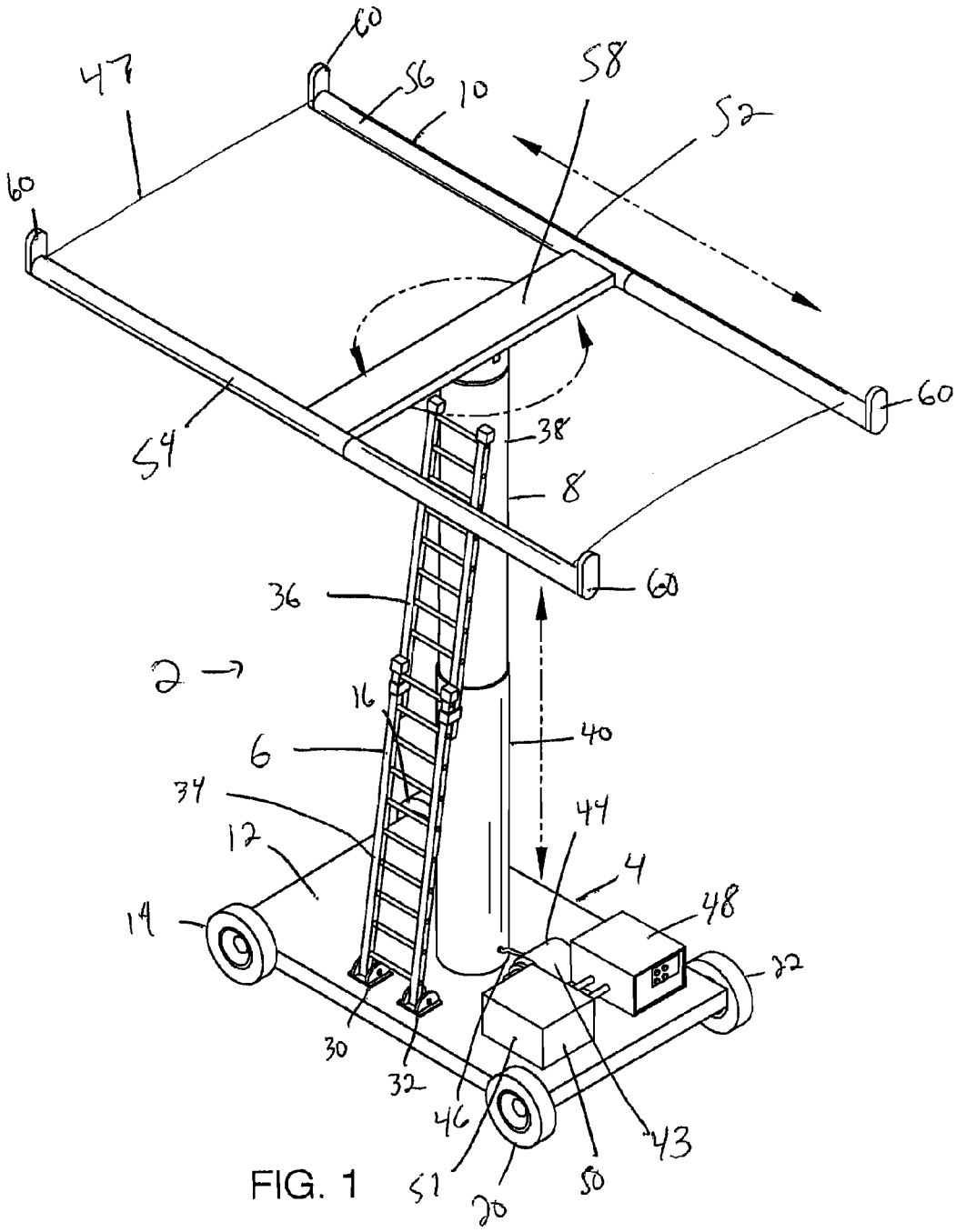
FIG. 1 shows a perspective view of the drywall lift assembly as it would appear in use.
Figure 2:
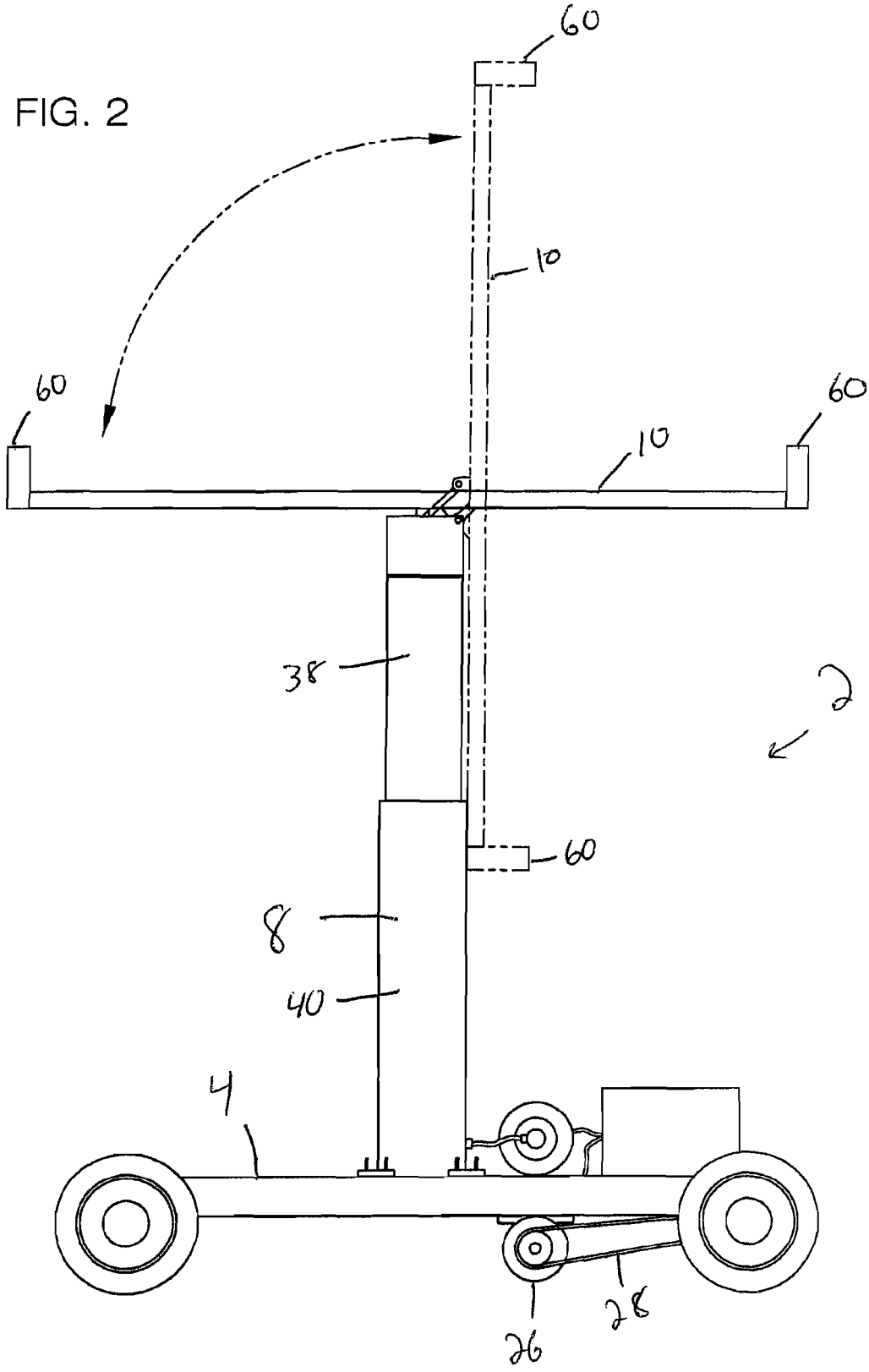
FIG. 2 shows a side view of the drywall lift assembly as it would appear in use.
Figure 3:
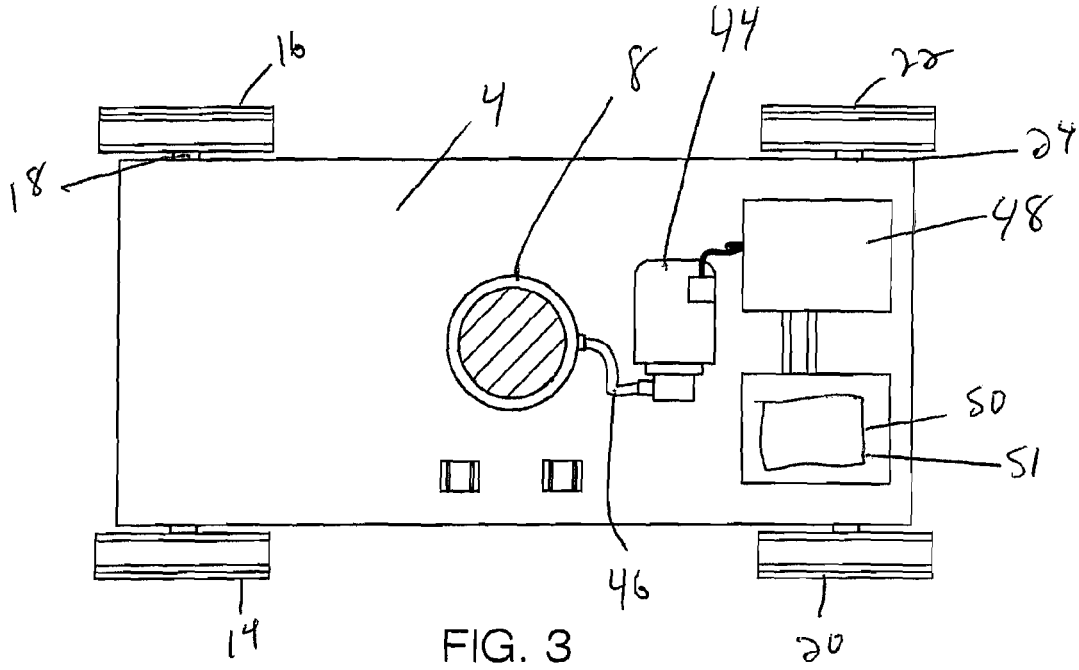
FIG. 3 shows a top view of the drywall lift assembly as it would appear in use.
Figure 4:
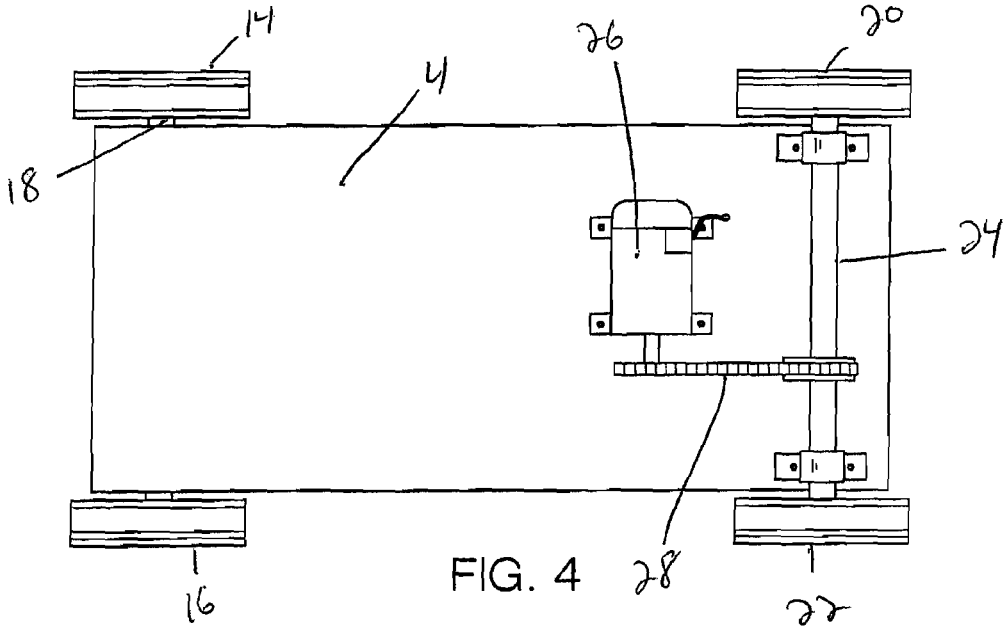
FIG. 4 shows a bottom view of the drywall lift assembly as it would appear in use.
Figure 5B:
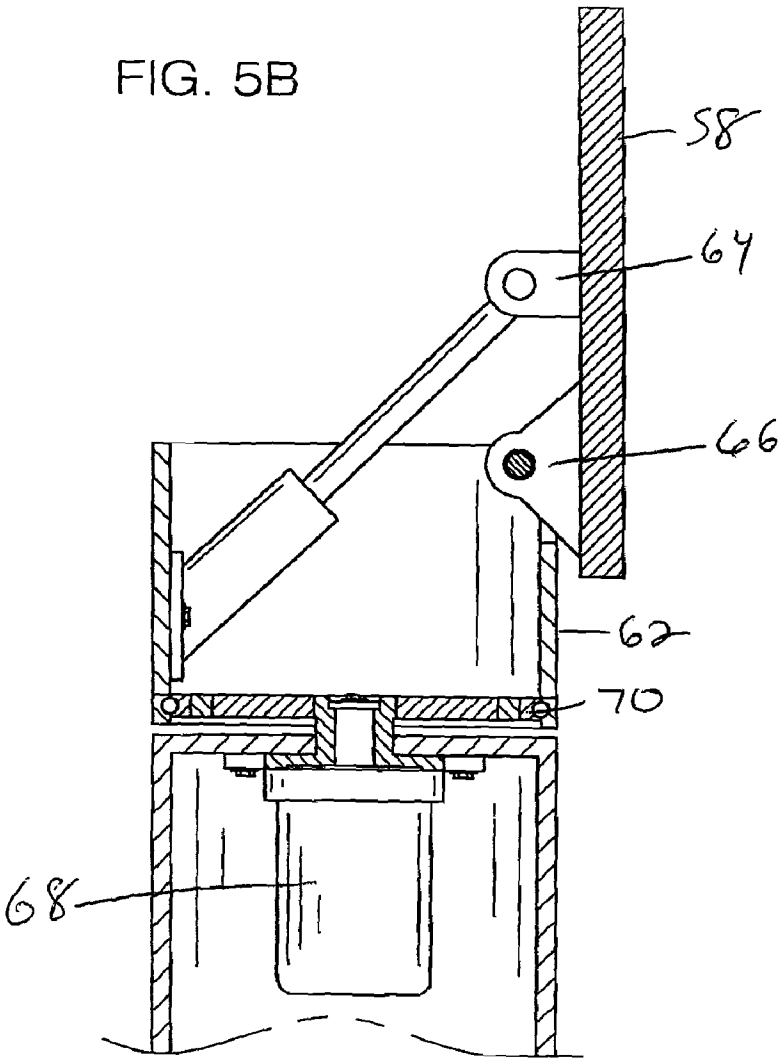
FIG. 5B shows a close-up perspective view of the swivel connection of the drywall lift assembly as it would appear in a raised position.
Figure 5A:
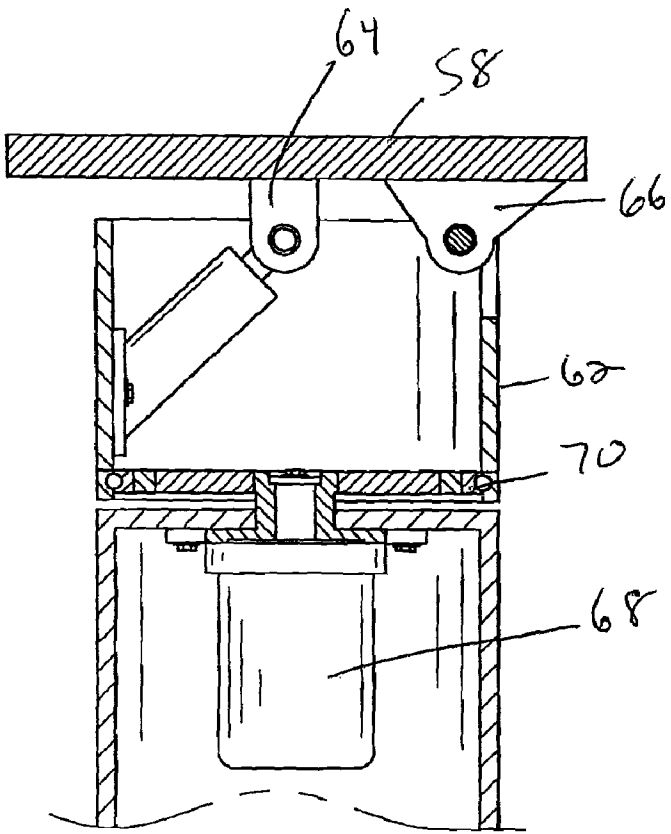
FIG. 5A shows a close-up perspective view of the swivel connection of the drywall lift assembly as it would appear in a lowered position.

With reference now to the drawings, and in particular to FIGS. 1 through 5A thereof, a new portable drywall lift assembly the principles and concepts of the present invention and generally designated by the reference numeral 2 will be described.

As best illustrated in FIGS. 1 through 6, the drywall lift assembly 2 comprises a base 4 that has two surfaces, a top surface and a bottom surface. The base 4 preferably has a rectangular shape and is in the form of a flat plate 12. The base 4 has two ends comprising a first end and a second end, and furthermore, has two side surfaces comprising a first side surface and a second side surface.

The base 4 is mounted atop four tires comprising a left front tire 14, a right front tire 16, a left rear tire 20, and a right rear tire 22. The left front tire 14 and right front tire 16 are connected by a front axle 18 which is mounted to the bottom surface of the base 4 near the first end of the base 4, while the left rear tire 20 and the right rear tire 22 are connected by a rear axle 24 which is mounted on the bottom surface of the base 4 near the second end of the base 4.

A drive motor 26 is also attached to the bottom surface of the base 4 and is connected to the rear axle 24 by a chain drive 28. The chain drive 28, once set into motion by drive motor 26, will force rear axle 24 to rotate, thereby propelling the drywall lift assembly 2 forward.

An extension ladder 6 is also present, with the extension ladder 6 comprising a lower section 34 and an upper section 36. The upper section 36 is attached to the lower section 34 and extends and retracts from the lower section 34. The lower section 34 itself is pivotally attached to the base 4 by a pair of ladder mounts 30 and 32. The upper section 36 of the extension ladder 6 is designed to be placed against the telescoping pole assembly 8 to allow an individual to place an item of drywall of flat paneling atop the telescoping pole assembly 8 on the support assembly 10.

The drywall lift assembly 2 also includes a telescoping pole assembly 8 which comprises a lower pole 40 and an upper pole 42. The lower pole 40 is fixedly attached to the top surface of the base 4, while the upper pole 38 is telescoping within the lower pole 40 and extends or retracts up and down from the lower pole 40. The height of the upper pole 38 is hydraulically controlled by a hydraulic pump motor 44 that is mounted on the top surface of the base 4, with the hydraulic motor 44 including a hydraulic medium 43 that is preferably liquid or water. A hydraulic line 46 connects the hydraulic pump motor 44 to the lower pole 40.

The hydraulic pump motor 44 itself is connected to a control panel box 48 that is mounted on the top surface of the base 4, with the control panel box 48 itself being attached to a battery compartment 50 which is also mounted on the top surface of the base 4. The battery compartment 50 is connected to the hydraulic pump motor 44 through the control panel box 48. The battery compartment 50 includes at least one battery 51 for ongoing power.

Located on top of the upper pole 38 of the telescoping pole assembly 8 is a swivel connection 42. Atop the swivel connection 42 is located a support assembly 10, with the support assembly 10 including a support structure 52 that has an "H shape." The support assembly is capable of holding an item of drywall or flat paneling 47. The support structure 52 includes a pair of parallel legs comprising a first parallel leg 54 and a second parallel leg 56, and furthermore, comprises a center leg 58 that connects the two of these two parallel legs together. The support structure 52 is mounted on top of the swivel connection 42 by placing the middle of the center leg 58 over the swivel connection 42. Each end of each of the two parallel legs 54 and 56 contains a plate 60 that can extend and retract about two inches.

The swivel connection 42 further comprises a central container 62 that is mounted atop the upper pole 38 of the telescoping pole assembly 8. The central container 62 includes a diagonally mounted hydraulic arm that is attached to flange 64, which is attached to the central leg 58. The center leg 58 itself is mounted to the central container 62 by a pivot point 66. The central container 62 itself is mounted atop the upper pole 38 of the telescoping pole assembly 8 by a rotating motor 68 and a ball bearing assembly 70, which allows the central container 62 to axially rotate atop the upper pole 38 of the telescoping pole assembly 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drywall lift assembly comprising:

a base, the base having two surfaces comprising a top surface and a bottom surface, the base also having two ends comprising a first end and a second end, the base also having two side surfaces comprising a first side surface and a second side surface, means for transporting the base, at least one item of drywall or flat paneling, means for mounting the item of drywall or flat paneling, wherein the means for transporting the base further comprises a quartet of tires comprising a left front tire, a right front tire, a left rear tire, and a right rear tire, a pair of axles comprising a front axle and a rear axle, wherein the front axle is mounted to the bottom surface of the base near the first end of the base, further wherein the rear axle is mounted to the bottom surface of the base near the second end of the base, further wherein the left front tire and the right front tire are connected to the front axle, and further wherein the left rear tire and the right rear tire are connected to the rear axle, wherein the means for transporting the base further comprises a drive motor attached to the bottom surface of the base, a chain drive attached connected to the drive motor, the chain drive also being connected to the rear axle, wherein operation of the drive motor causes the rear axle to rotate through movement of the chain drive, wherein the means for mounting the item of drywall or flat paneling further comprises a telescoping pole assembly, the telescoping pole assembly comprising a lower pole and an upper pole, wherein the lower pole of the telescoping pole assembly is fixedly attached to the top surface of the base, further wherein the upper pole is telescoping within the lower pole and extends or retracts up and down from the lower pole, and means for moving the upper pole of the telescoping pole assembly up or down in relation to the lower pole of the telescoping pole assembly, wherein the means for moving the upper pole of the telescoping pole assembly up or down in relation to the lower pole of the telescoping pole assembly further comprises a hydraulic pump motor mounted on the top surface of the base, a hydraulic line attached to the hydraulic pump motor, the hydraulic line also attached to the lower pole, a hydraulic medium located within the hydraulic line and the hydraulic pump motor, means for operating the hydraulic pump motor, and power means for providing power to the hydraulic pump motor, wherein the means for operating the hydraulic pump motor further comprises a control panel box mounted on the top surface of the base, wherein the control panel box is connected to the hydraulic pump motor, wherein the power means for providing power to the hydraulic pump motor further comprises a battery compartment mounted on the top surface of the base, at least one battery located within the battery compartment, wherein the battery compartment is connected to the control panel box, further wherein the battery compartment is connected to the hydraulic pump through the control panel box, wherein the means for mounting the item of drywall or flat paneling further comprises an extension ladder, the extension ladder comprising two sections comprising an upper section and a lower section, the upper section of the extension ladder being attached to the lower section of the extension ladder, wherein the lower section of the ladder is pivotally attached to the base, wherein the means for mounting the item of drywall or flat paneling further comprises a support assembly, means for mounting the support assembly atop the upper pole of the telescoping pole assembly, wherein an item of drywall or flat paneling can be placed on the support assembly for mounting to a vertical or horizontal surface, wherein the support assembly further comprises a pair of parallel legs comprising a first parallel leg and a second parallel leg, and a center leg that connects the two parallel legs to one another, wherein the means for mounting the support assembly atop the upper pole of the telescoping pole assembly further comprises a swivel connection, the swivel connection being located atop the upper pole of the telescoping pole assembly, wherein the swivel connection atop the upper pole of the telescoping pole assembly further comprises a central container located atop the upper pole of the telescoping pole assembly, a flange attached to the center leg, a diagonally mounted hydraulic arm attached to the flange, and wherein the center leg is pivotally attached to the central container, wherein the swivel connection atop the upper pole of the telescoping pole assembly further comprises a rotating motor located atop the upper pole of the telescoping pole assembly, a ball bearing assembly associated with the rotating motor, wherein the central container is located on top of the rotating motor.

2. A drywall lift assembly comprising (a) a base, the base having two surfaces comprising a top surface and a bottom surface, the base also having two ends comprising a first end and a second end, the base also having two side surfaces comprising a first side surface and a second side surface, (b) means for transporting the base, said means further comprising (i) a quartet of tires comprising a left front tire, a right front tire, a left rear tire, and a right rear tire, (ii) a pair of axles comprising a front axle and a rear axle, (iii) wherein the front axle is mounted to the bottom surface of the base near the first end of the base, (iv) further wherein the rear axle is mounted to the bottom surface of the base near the second end of the base, (v) further wherein the left front tire and the right front tire are connected to the front axle, (vi) further wherein the left rear tire and the right rear tire are connected to the rear axle, (vii) a drive motor attached to the bottom surface of the base, (viii) a chain drive attached connected to the drive motor, the chain drive also being connected to the rear axle, (ix) wherein operation of the drive motor causes the rear axle to rotate through movement of the chain drive (c) at least one item of drywall or flat paneling, and (d) means for mounting the item of drywall or flat paneling, said means further comprising (i) a telescoping pole assembly, the telescoping pole assembly comprising a lower pole and an upper pole, wherein the lower pole of the telescoping pole assembly is fixedly attached to the top surface of the base, further wherein the upper pole is telescoping within the lower pole and extends or retracts up and down from the lower pole, (ii) means for moving the upper pole of the telescoping pole assembly up or down in relation to the lower pole of the telescoping pole assembly, said means comprising (1) a hydraulic pump motor mounted on the top surface of the base, (2) a hydraulic line attached to the hydraulic pump motor, the hydraulic line also attached to the lower pole, (3) a hydraulic medium located within the hydraulic line and the hydraulic pump motor, (4) means for operating the hydraulic pump motor, said means comprising a control panel box mounted on the top surface of the base, wherein the control panel box is connected to the hydraulic pump motor and (5) power means for providing power to the hydraulic pump motor, said power means comprising a battery compartment mounted on the top surface of the base, said means further comprising at least one battery located within the battery compartment, wherein the battery compartment is connected to the control panel box, further wherein the battery compartment is connected to the hydraulic pump through the control panel box, (iii) an extension ladder, the extension ladder comprising two sections comprising an upper section and a lower section, the upper section of the extension ladder being attached to the lower section of the extension ladder, wherein the lower section of the ladder is pivotally attached to the base, (iv) a support assembly, said support assembly further comprising (1) a pair of parallel legs comprising a first parallel leg and a second parallel leg, and (2) a center leg that connects the two parallel legs to one another, (v) means for mounting the support assembly atop the upper pole of the telescoping pole assembly, wherein an item of drywall or flat paneling can be placed on the support assembly for mounting to a vertical or horizontal surface, said means further comprising a swivel connection, the swivel connection being located atop the upper pole of the telescoping pole assembly, the swivel connection further comprising (1) a central container located atop the upper pole of the telescoping pole assembly, (2) a flange attached to the center leg, (3) a diagonally mounted hydraulic arm attached to the flange, (4) wherein the center leg is pivotally attached to the central container, (5) a rotating motor located atop the upper pole of the telescoping pole assembly, (6) a ball bearing assembly associated with the rotating motor, (7) wherein the central container is located on top of the rotating motor.

* * * * *